US005193360A

United States Patent [19]

Lovegrove

[11] Patent Number: 5,193,360

[45] Date of Patent: Mar. 16, 1993

[54] TABLET FINGER RING HAVING A REMOVABLE TABLET

[76] Inventor: Daniel C. Lovegrove, 4 Valley Forge Rd., Darien, Conn. 06820

[21] Appl. No.: 873,144

[22] Filed: Apr. 24, 1992

Related U.S. Application Data

[63] Continuation-in-part of Ser. No. 767,891, Sep. 30, 1991, abandoned.

[51] Int. Cl.[5] ..... A44C 9/00

[52] U.S. Cl. ..... 63/15; 63/1.1; 40/639

[58] Field of Search ..... 40/639, 5; 63/15–15.8, 63/18, 23, 1.1, 2; 312/333, 330.1

[56] References Cited

U.S. PATENT DOCUMENTS

| | | | |
|---|---|---|---|
| 1,130,917 | 3/1915 | Meyer | 63/15 |
| 1,664,994 | 4/1928 | Rea . | |
| 1,740,060 | 12/1929 | Baum | 63/15 |
| 1,752,719 | 4/1930 | Baum | 63/15 |
| 1,889,862 | 12/1932 | Kessler | 40/639 |
| 1,952,203 | 3/1934 | Fox | 122/79 |
| 2,182,876 | 12/1939 | Moldenhaver | 63/15 |
| 2,223,657 | 12/1940 | Baden | 63/15 |
| 2,453,190 | 11/1948 | Boscowitz | 63/1 |
| 3,509,734 | 5/1970 | Lederer | 63/29.2 |
| 4,116,512 | 9/1978 | Wiser | 312/330.1 |
| 4,174,620 | 11/1979 | Russell | 63/29.2 |

FOREIGN PATENT DOCUMENTS

| | | | |
|---|---|---|---|
| 375393 | 3/1907 | France | 63/1.1 |
| 798861 | 3/1936 | France | 63/15 |
| 546346 | 1/1942 | United Kingdom | 63/15 |
| 706148 | 2/1952 | United Kingdom | 63/15 |
| 2032764 | 5/1980 | United Kingdom | 63/1.1 |

*Primary Examiner*—Renee S. Luebke
*Assistant Examiner*—Flemming Saether
*Attorney, Agent, or Firm*—Shlesinger Arkwright & Garvey

[57] ABSTRACT

This invention is a tablet finger ring which includes a finger-engaging band portion and a head portion. The head position is provided with a slot below the upper surface thereof in which is slidably positioned a tablet on which inscriptions or the like may be applied to the upper surface thereof. The tablet is completely removable from the slot to apply the inscription and to read the same. A magnet fixed to the head portion holds the tablet in fully inserted position in the slot to prevent accidental disengagement of the tablet from the head portion. Grooves on the undersurface of the tablet facilitate removal of the tablet from the slot against the magnetic force exerted on the tablet by the magnet.

18 Claims, 2 Drawing Sheets

TABLET FINGER RING HAVING A REMOVABLE TABLET

This application is a continuation in part of application Ser. No. 07/767,891 filed Sep. 30, 1991, now abandoned.

FIELD OF THE INVENTION

This invention is a finger ring having a normally concealed tablet therein bearing inscriptions or the like, which tablet may be removed from the body of the ring to expose the tablet so that the inscriptions may be read.

BACKGROUND OF THE INVENTION

Finger rings have been designed which, in addition to their ornamental function, are provided with a compartment into which small photographs or other articles may be placed. Such rings are illustrated in U.S. Pat. No. 1,752,719 issued Apr. 1, 1930, U.S. Pat. No. 2,223,657 issued Dec. 3, 1940, and U.S. Pat. No. 2,357,697 issued Sep. 5, 1944. These patents disclose a variety of ways in which the compartment may be attached to the ring, but none of them provides a ring of conventional appearance wherein the compartment conforms to the contour of the ring and is completely removable from the body of the ring.

SUMMARY OF THE INVENTION

The present invention is a tablet finger ring of conventional appearance including a finger-engaging band portion which is fixedly connected to a head portion. A slot is formed in the head portion below the upper surface thereof into which a tablet is slidably inserted. The tablet includes a flat surface on which personal information, inscriptions or the like may be inscribed. The end of the tablet complements the shape of the portion of the ring adjacent to slot so that, in the closed position, the tablet blends into the contour of the ring and, therefore, the ring has the appearance of a conventional ring.

The tablet is designed to be positioned in the slot and is slidable therein from a fully closed position to a position removed from the body of the ring. Means are provided for holding the tablet in closed position to prevent accidental disengagement of the tablet from the slot. These means comprise a magnet fixed to the ring at the inner end of the slot which attracts and holds the tablet which is made of a material having magnetic characteristics which is drawn to the magnet.

The portion of the finger ring subjacent the tablet is open, and the outer surface of the tablet is provided with fingernail-engaging means to facilitate removal of the tablet from the slot against the magnetic force of the magnet. These means include a series of grooves extending transversely of the outer surface of the tablet into which a fingernail may be inserted, following which the finger is moved in a direction away from the magnet to effect ready removal of the tablet.

This enables the tablet to be completely removed from the ring, so that inscriptions may be applied to the upper surface of the tablet, and also enables the wearer to inspect the inscriptions as desired.

The tablet may then be reinserted into the slot until the inner end thereof is magnetically drawn into contiguous engagement with the ring, at which time the outer end of the tablet is aligned with the adjacent portion of the ring body.

DETAILED DESCRIPTION OF THE INVENTION

Figure 1:
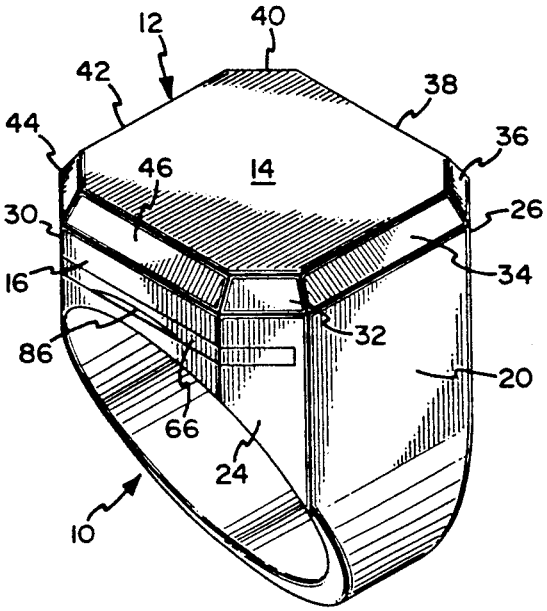
FIG. 1 is a front perspective view of a tablet finger ring constructed in accordance with the present invention.
Figure 2:
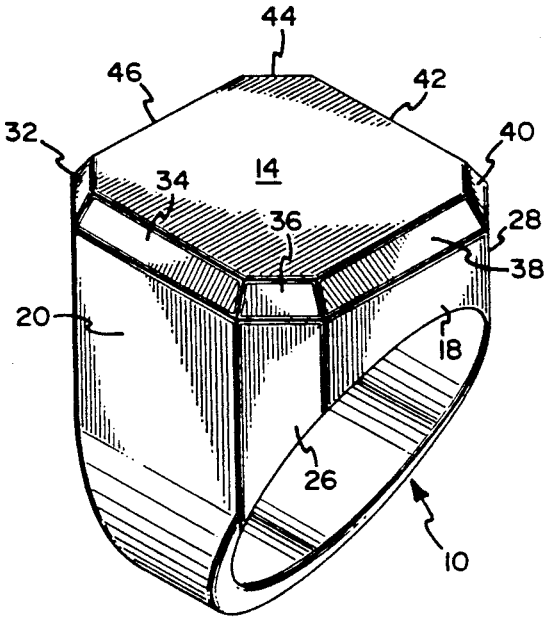
FIG. 2 is a rear perspective view thereof.
Figure 3:
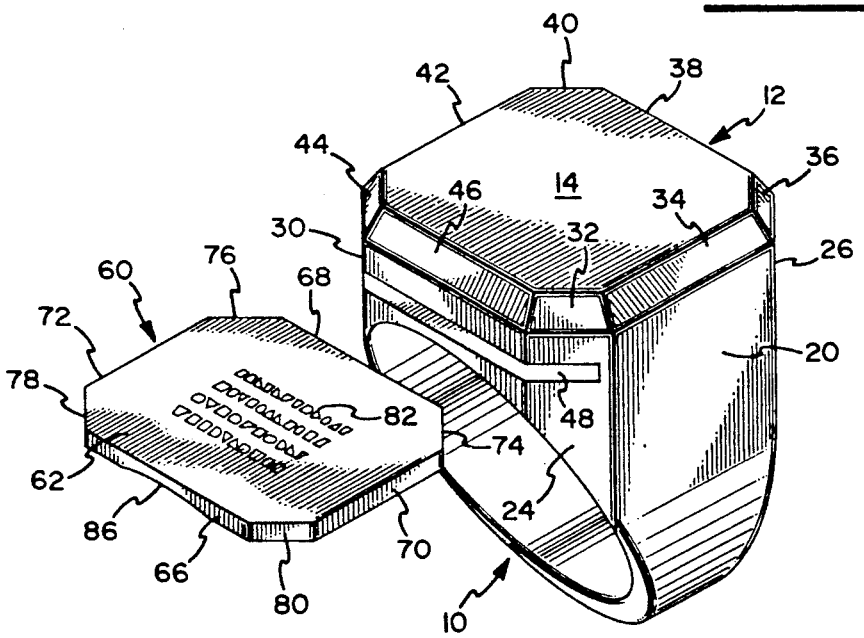
FIG. 3 is a perspective view, showing the tablet forming a part of the present invention in fully removed position.

The finger ring of the present invention includes a finger-engaging annular band portion 10 to which is fixedly engaged a head portion 12 which includes a top 14 of any suitable design, a front wall 16, a rear wall 18 and side walls 20 and 22. Front wall 16, rear wall 28 and side walls 20 and 22 are connected by angular connecting wall portions designated 24, 26, 28 and 30.

There are also provided beveled wall portions between the front, rear, side walls and top of the head portion, as indicated at 32, 34, 36, 38, 40, 42, 44 and 46.

In accordance with the present invention, a slot 48 extends through front wall 16 and connecting wall portions 24 and 30, which slot communicates with a larger opening 50 in head portion 12 which extends from wall 16 to a point in proximity to rear wall 18 and side walls 20 and 22. Opening 50 extends downwardly entirely through head portion 12 and band portion 10, the lower edge of the head and band portion defining the opening being provided with a peripheral flange 52.

A body magnet 54 is secured to the interior of wall 18 and rests on flange 52, the magnet extending across the major portion of opening 50 between side walls 20 and 22. Magnet 54 is fixed to head portion 12 near an inner end of slot 48.

Figure 4:
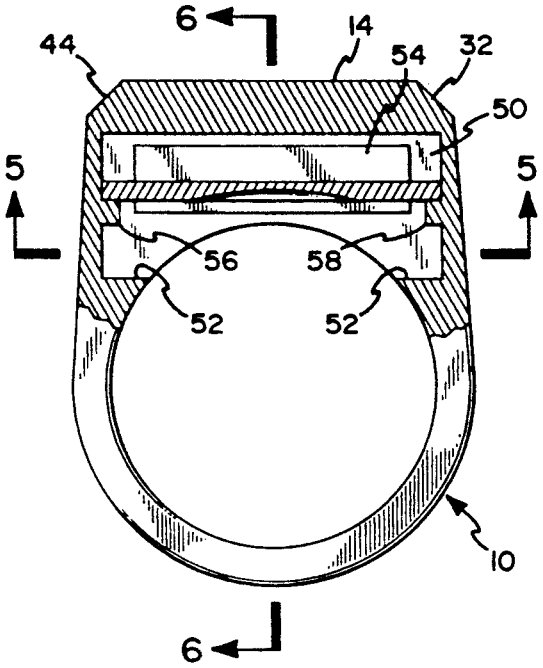
FIG. 4 is a front elevational view of the tablet ring, portions thereof being broken away to disclose details of construction.
Figure 6:
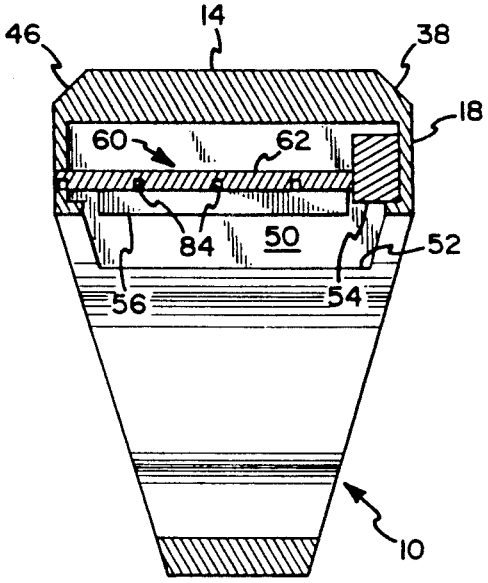
FIG. 6 is a sectional view taken along the line 6—6 of FIG. 4, looking in the direction of the arrows.
Figure 5:
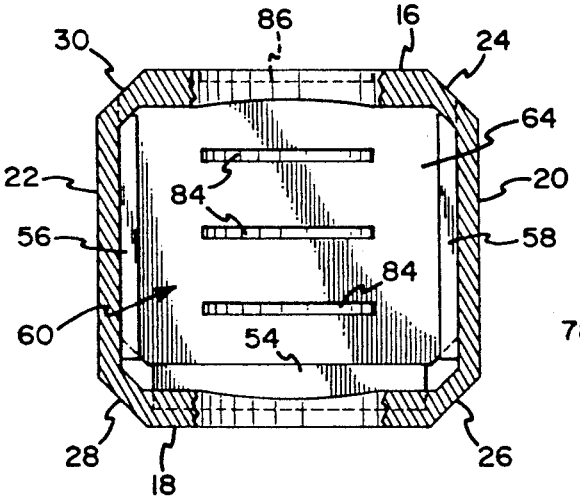
FIG. 5 is a sectional view taken along the line 5—5 of FIG. 4, looking in the direction of the arrows.
Figure 7:
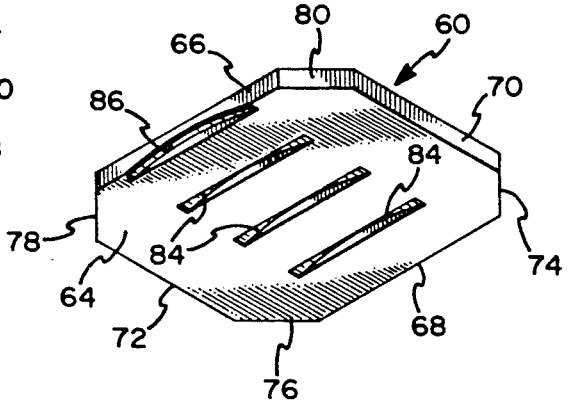
FIG. 7 is a bottom perspective view of the tablet forming a part of the present invention.

As shown to advantage in FIG. 4, side walls 18 and 22 are provided with opposed inwardly-directed ribs or flanges 56 and 58 which are located intermediate the height of opening 50 and are adapted to support a tablet 60 which is inserted through slot 48 into opening 50 of the ring.

Tablet 60 is made of a suitable magnetically attracted metallic material and includes a flat body portion of a thickness which is slightly less than the height of slot 48 in order to permit insertion of the tablet therethrough.

In the form of invention illustrated in the drawings, tablet 60 is of octagonal shape, having an upper surface 62 and a lower surface 64. The tablet includes front and rear edges 66 and 68 and side edges 70 and 72. The front, rear and side edges are connected by angular edge portions 74, 76, 78 and 80 so that, when the tablet is in the closed position illustrated in FIG. 1, the contour of the visible edges of tablet 60 is the same as that of the head portion of the ring. The tablet may be of various shapes to conform to the contour of the head portion of the ring.

The upper surface of tablet 60 is inscribed with indicia 82 which may be engraved or applied in any other suitable fashion thereto, and may include any desired information, such as historical data, quotations, personal accomplishments, family history, etc. The lower surface 64 of tablet 60 is provided with a series of transverse, spaced grooves 84 which are exposed when the ring is removed from the finger, and therefore may be readily engaged by a fingernail or tool to remove the tablet from the ring in order to apply inscriptions to upper surface 62.

The tablet is then reinserted into the ring through slot 48 and remains hidden from view during normal wear of the ring.

When it is desired to view the indicia while on the finger, a notch 86 in the front edge 68 of tablet 60 is engaged by a fingernail or tool to pull the tablet out of the ring for viewing the indicia 80 on the upper surface thereof.

The tablet finger ring of the present invention has the appearance of a conventional ring and, although provided with a tablet, the contour thereof conforms to the contour of the remainder of the ring, and no portions thereof extend beyond the periphery of the ring when the tablet is fully inserted into the head portion. The ring of the present invention provides a tablet on which any desired indicia may be placed, the tablet being normally concealed from view and held by magnetic force in position to prevent accidental disengagement of the tablet from the ring. By virtue of the present construction, the tablet is readily removable for viewing or removal at any time.

While there has been herein shown and described the presently preferred form of this invention, it is to be understood that such has been done for purposes of illustration only, and that various changes may be made therein within the scope of the appended claims.

What I claim is:

1. A tablet finger ring comprising:

a) an annular band portion;

b) a head portion connected to said annular band portion;

c) said head portion being provided with a slot extending transversely thereof;

d) said slot having an inner end;

e) a completely removable and detachable tablet having upper and lower surfaces insertable into the slot of said head portion;

f) said tablet bearing indicia on the upper surface thereof and being movable from a fully inserted position to normally conceal the surface from view, to a fully removed position distant and detached from said head portion for applying indicia thereto, and to examine the same; and g) magnetic means for normally holding the tablet in the fully inserted position to prevent accidental disengagement.

2. The tablet finger ring of claim 1, wherein:

a) said magnetic means comprises a magnet fixed to said head portion near the inner end of the slot; and b) said tablet being made of a magnetically attractable material.

3. The tablet finger ring of claim 1, with the addition of:

a) at least one groove on the lower surface of said tablet and extending transversely thereof, said groove being engaged by a fingernail to move the tablet in a direction to remove the tablet from the slot.

4. The tablet finger ring of claim 1, with the addition of:

a) a plurality of spaced grooves extending transversely of the lower surface of said tablet, said grooves being selectively engaged by a fingernail to move the tablet in a direction to remove the tablet from the slot.

5. The tablet finger ring of claim 1, with the addition of:

a) a notch on an end portion of said tablet which is exposed when the tablet is fully inserted into said slot, the notch being engaged by a fingernail to move the tablet in a direction to remove it from the slot.

6. A tablet finger ring comprising:

a) an annular band portion;

b) a head portion connected to said annular band portion;

c) said head portion being provided with a slot below the upper surface thereof, extending from a first end thereof to a point proximate a second end thereof;

d) said slot having an inner end;

e) supporting means within said head portion adjacent the slot thereof;

f) a tablet having upper and lower surfaces insertable into the slot of said head portion and engaged with said supporting means, said tablet being movable to a fully removed position distant and detached from said head portion;

g) indicia applied to the upper surface of said tablet;

h) magnetic means for holding said tablet when it is fully inserted into the slot, to normally conceal the tablet from view; and i) said table being retained in said slot substantially only by said magnetic means.

7. The tablet finger ring of claim 6, wherein:

a) said magnetic means comprises a body magnet attached to said head portion at the inner end of the slot proximate the second end thereof;

b) said tablet being made of a material attracted by said body magnet thereby effecting contiguous engagement of said tablet with said body magnet to normally prevent accidental disengagement of said tablet from the slot of the head portion.

8. The tablet finger ring of claim 7, wherein:

a) said supporting means comprises a pair of spaced, opposed ribs on said head portion adjacent the slot and lying in supporting engagement with portions of said tablet; said tablet being slidably movable on said ribs.

9. The table finger ring of claim 8, with the addition of:

a) means on the lower surface of said table for facilitating removal of said tablet from the slot;

b) said head portion and band portion being provided with an opening to permit access to said facilitating means.

10. The tablet finger ring of claim 9, wherein:

a) said facilitating means comprises at least one groove extending transversely of the lower surface of said tablet, said groove being engaged by a fingernail to move the tablet in a direction to remove the tablet from the slot.

11. The tablet finger ring of claim 9, with the addition of:

a) a plurality of spaced grooves extending transversely of the lower surface of said tablet, said grooves being selectively engaged by a fingernail to move the tablet in a direction to remove the tablet from the slot.

12. The tablet finger ring of claim 11, with the addition of:

a) a notch on an end portion of s id tablet which is exposed when the tablet is fully inserted into said slot, the notch being engaged by a fingernail to move the tablet in a direction to remove it from the slot.

13. A tablet finger ring comprising:

a) an annular band portion;

b) a head portion connected to said annular band portion;

c) said head portion being provided with a slot extending transversely thereof;

d) a tablet having upper and lower surfaces insertable into the slot of said head portion;

e) said tablet bearing indicia on the upper surface thereof and movable from a fully inserted position to normally conceal the surface from view, to a fully removed position for applying indicia thereto, and to examine the same;

f) a plurality of spaced grooves extending transversely of the lower surface of said tablet, said grooves being selectively engaged by a fingernail to move the tablet in a direction to remove the tablet from the slot; and g) magnetic means for normally holding the table tin a fully inserted position to prevent accidental disengagement.

14. The tablet finger ring of claim 13, wherein:

a) said magnetic means comprises a magnet fixed to said head portion near an inner end of the slot; and b) said tablet being made of a magnetically attractable material.

15. A tablet finger ring comprising:

a) an annular band portion;

b) a head portion connected to said annular band portion;

c) said head portion being provided with a slot below the upper surface thereof, extending from a first end thereof to a point proximate a second end thereof;

d) said slot having an inner end;

e) supporting means within said head portion adjacent the slot thereof;

f) a tablet having upper and lower surfaces insertable into the slot of said head portion and engaged with said supporting means;

g) indicia applied to the upper surface of said tablet;

h) a plurality of spaced grooves extending transversely of the lower surface of said tablet, said grooves being selectively engaged by a fingernail to move the tablet in a direction to remove the tablet from the slot; and i) magnetic means for holding said tablet when it is fully inserted into the slot, to normally conceal the tablet from view.

16. The tablet finger ring of claim 15, with the addition of:

a) a notch on an end portion of said tablet which is exposed when the tablet is fully inserted into said slot, the notch being engaged by a fingernail to move the tablet in a direction to remove it from the slot.

17. A tablet finger ring comprising:

a) an annular band portion;

b) a head portion connected to said annular band portion;

c) said head portion being provided with a slot extending transversely thereof;

d) said slot having an inner end;

e) a completely removable and detachable tablet having upper and lower surfaces insertable into the slot of said head portion;

f) said tablet bearing indicia on the upper surface thereof and being movable from a fully inserted position to normally conceal the surface from view, to a fully removed position distant and detached from said head portion for applying indicia thereto, and to examine the same;

g) magnetic means for normally holding the tablet in the fully inserted position to prevent accidental disengagement; and h) fingernail-engaging means disposed on the outer surface of the tablet to facilitate removal of the tablet from the slot against the magnetic force of the magnet.

18. The tablet finger ring of claim 17, wherein:

a) said fingernail-engaging means includes a groove.

* * * * *